United States Patent [19]

Hill

[11] Patent Number: 4,619,123

[45] Date of Patent: Oct. 28, 1986

[54] GUARD PLATE AND METHOD FOR AUTOMOBILE DOOR HANDLE

[76] Inventor: Mark L. Hill, 512 So. 4th Ave., Tucson, Ariz. 85701

[21] Appl. No.: 691,541

[22] Filed: Jan. 14, 1985

[51] Int. Cl.[4] ..... E05B 63/00

[52] U.S. Cl. ..... 70/417; 70/418

[58] Field of Search ..... 70/417, 418, 452; 292/348, 350, 351, 346

[56] References Cited

U.S. PATENT DOCUMENTS

| | | | |
|---|---|---|---|
| 1,787,707 | 1/1931 | Sullivan . | |
| 2,189,845 | 2/1940 | Terrill | 287/53 |
| 2,924,480 | 2/1960 | Holland | 292/336.3 |
| 3,083,563 | 4/1963 | Greenwald | 70/417 |
| 3,211,487 | 10/1965 | Maursey | 292/353 |
| 3,606,429 | 9/1971 | Palmer | 282/340 |
| 3,976,318 | 8/1976 | Krus | 292/346 |
| 4,041,741 | 8/1977 | Clintron | 70/417 |
| 4,074,552 | 2/1978 | Smith | 70/417 |
| 4,132,092 | 1/1979 | Steinbach | 70/208 |
| 4,212,176 | 7/1980 | Hegedus | 70/417 |
| 4,397,168 | 8/1983 | Rotondi et al. | 70/417 |

FOREIGN PATENT DOCUMENTS

| | | | |
|---|---|---|---|
| 13613 | of 1909 | United Kingdom | 70/452 |
| 440127 | 1/1936 | United Kingdom . | |

*Primary Examiner*—Robert L. Wolfe

*Attorney, Agent, or Firm*—Cahill, Sutton & Thomas

[57] ABSTRACT

A stainless steel guard plate for preventing forced entry into certain automobilies by forcing a screwdriver between the door handle mechanism and the outer door panel to unlock the door is retrofitted to the automobile. The handle mechanism is removed from an opening in the door. The guard plate includes a stainless steel plate having an aperture through which an operative portion of the handle mechanism extends, with side flanges of the guard plate extending inwardly along the upper and lower edges of the guard plate aperture and through the original opening in the door panel. A first screw which is accessible through a rear end plate of the door when it is opened, passes through a hole in an inwardly extending tab of the guard plate and into a threaded hole in a tongue member of the handle mechanism. The first screw is tightened, drawing the rear portion of the handle mechanism tightly against the guard plate, pressing it tightly against the outer surface of the door panel. A second screw extending through the forward part of the handle is used to tighten the front end of the handle against the door panel.

9 Claims, 7 Drawing Figures

GUARD PLATE AND METHOD FOR AUTOMOBILE DOOR HANDLE

BACKGROUND OF THE INVENTION

The invention relates to guard plates for preventing forced entry into an automobile, and more particularly to guard plates which can be placed between a handle and an outer surface of the door panel of certain automobiles which are easily broken into by forcing a screwdriver between the door panel and the handle to trip a locking mechanism, particularly certain Volkswagen, Porsche, and certain Audi automobiles.

The Volkswagen Rabbit is notoriously easy for thieves to break into. Within the first year of owning my Volkswagen Rabbit, it was broken into six times. In the course of trying to determine if there was a way of making my Volkswagen Rabbit more theft-proof, I discovered that a large number of the Volkswagen Rabbits that I see parked on the street have been broken into in the same manner as mine. Such vehicles are easy to notice because of visible damage done to them, as indicated in FIG. 1. The technique for breaking into them simply involves forcing the flat blade of a screwdriver shaft 5 between the upper edge 4 of the door handle mechanism 1 and the outer surface of the door panel 2. By suitably manipulating the handle 6 of the screwdriver, a thief can easily force the flat blade downward and inward into the door, producing visible bending and damage 7 to the door panel 2. After the screwdriver shaft 5 has been inserted a certain distance (approximately 2 inches), the handle 6 is then pried outward, away from the door, and a portion of the blade extending inside the door through the bent metal 7 trips the door locking mechanism, unlocking the door. The would-be thief then simply opens the door in the usual manner and proceeds to remove the automobile's stereo system or whatever other valuable items he desires.

This problem has been a great source of frustration to me and, I have found, to many other owners of Volkswagen Rabbits. Although there is quite a lot of prior art on providing guard plates and other techniques for preventing forced entry into a wide variety of locked doors in buildings and in vehicles, as indicated in U.S. Pat. Nos. 4,212,176; 4,132,092; 3,083,563; 3,041,741; 3,606,429; 4,074,552; 3,976,318; and 4,397,168, I was unable to find any device that would make the door locks of my Volkswagen Rabbit more theft-proof.

It is very clear that there is an unmet need for a simple, economical device that will make it much more difficult to force entry into Volkswagen Rabbits and other such vehicles that are easily broken into.

SUMMARY OF THE INVENTION

Briefly described, and in accordance with one embodiment thereof, the invention provides a guard plate apparatus disposed between the outer surface of an automobile door panel and its handle mechanism for preventing forcing of a screwdriver blade or the like between the door panel and the handle mechanism, and thereby preventing manipulation of the screwdriver to unlock the automobile door. The described embodiment of the invention can be easily retrofitted to Volkswagen Rabbit automobiles, certain models of Porsche automobiles, and certain models of Audi automobiles, and also to certain Volkswagen trucks. The method of retrofitting includes removal of the handle mechanism by opening the door and removing a hidden first screw that extends through the end plate of the opened door and into a threaded hole in a tongue member that is rigidly attached to the handle mechanism. A piece of trim on the outer surface of the handle mechanism is removed to expose a screw that attaches the forward end of the handle mechanism to the door panel. The handle mechanism then is removed from the door. A bezel is removed, and the guard plate of the present invention is inserted into the door panel opening from which the handle mechanism was removed. The guard plate has a generally oblong configuration and an inner surface that mates precisely to the contour of the door around the handle-receiving opening. A pair of rigid flanges extend perpendicularly and inwardly from the upper edge and lower edge, respectively, of an aperture in the guard plate, which aperture is configured to be aligned with the opening in the door panel and which receives the reinstalled handle mechanism. A rigid, inwardly oriented tab having a clearance hole therein is aligned with a threaded hole in the tongue member of the handle mechanism when the handle mechanism is inserted through the aperture in the guard plate. Both the threaded hole and the clearance hole are aligned with the clearance hole in the end plate of the open door. The first screw then is threaded into the hole in the tongue member, tightening the handle mechanism and the guard plate in place. The second screw is reinstalled to retain the forward end of the handle mechanism in a corresponding hole in the door panel, and the piece of trim is replaced to cover the second screw. The guard plate makes it very difficult for a screwdriver to be inserted between the guard plate and the metal of the door panel. If a would-be thief manages to force the screwdriver between the guard plate and the door panel, the upper rigid flange of the guard plate prevents further insertion of the screwdriver.

DESCRIPTION OF THE INVENTION

Figure 2:
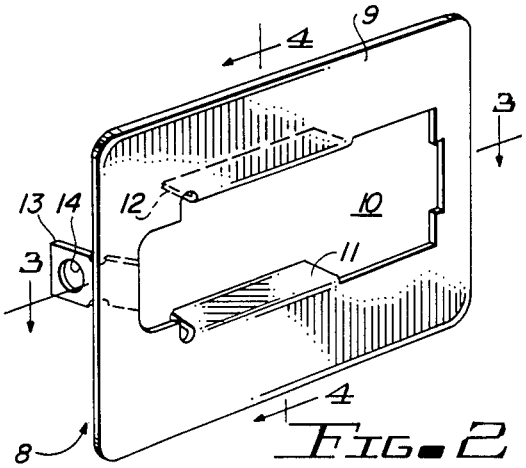
FIG. 2 is a perspective view of the guard plate of the present invention.
Figure 3:
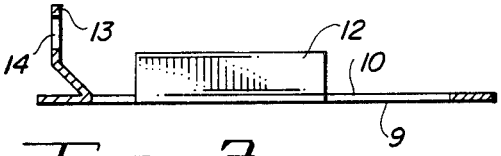
FIG. 3 is a section view taken along section line 3—3 of FIG. 2.
Figure 4:
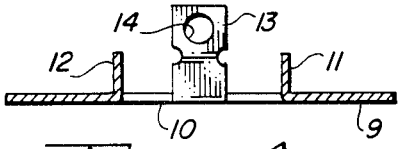
FIG. 4 is a section view taken along section line 4—4 of FIG. 2.

Referring now to FIGS. 2–4, guard plate 8 is composed of 0.035 inch thickness stainless steel plate material. It includes a rectangular plate 9 having an opening 10 therein which corresponds quite precisely to the opening 18 (FIG. 5) in the outside panel of an automobile door. The opening 10 allows the inner portion of handle mechanism 1 to be inserted into opening 10 in the same fashion that it is originally inserted through hole 18 in the door panel 2. The inner surface of plate 9 preferably is contoured to precisely match the contour of the metal around opening 18 in door panel 2.

A perpendicular flange 11 extends inwardly from the lower rear edge of aperture 10 in plate 9, and a similar upper flange 12 extends inwardly from the upper edge of opening 10. The two flanges 11 and 12 fit precisely into door panel opening 18 during installation of guard plate 8.

At the rear end of aperture 10, a rigid tab 13 extends inwardly. A clearance hole 14 is provided in tab 13 for receiving a screw 17 (FIG. 5) that anchors the handle mechanism to door 2.

Figure 5:
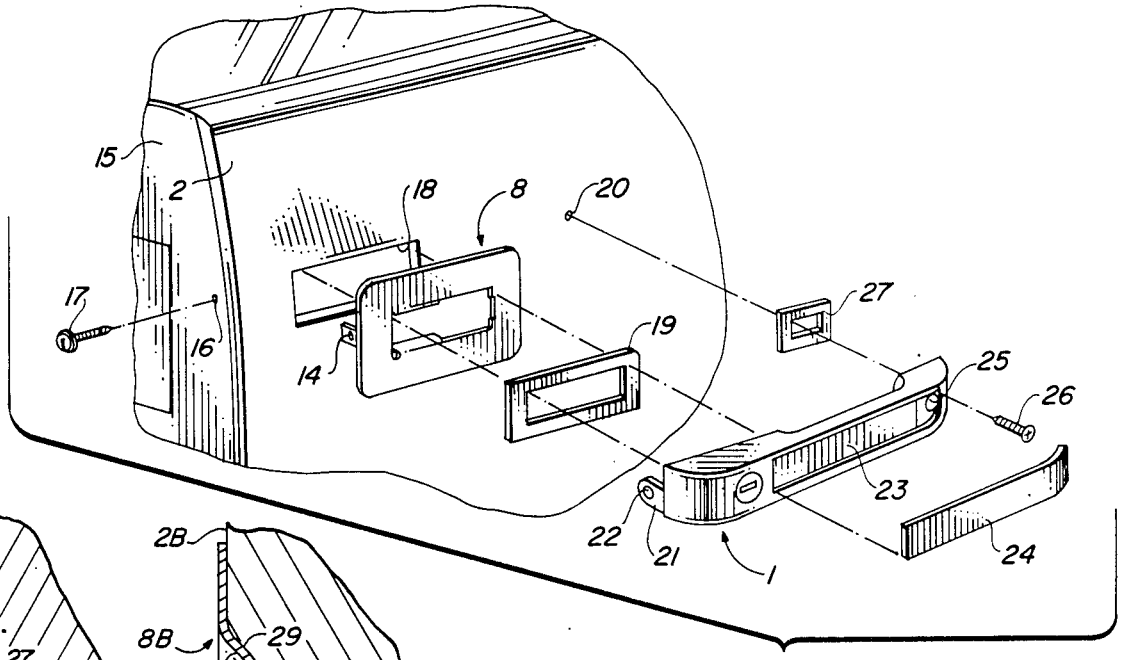
FIG. 5 is an exploded view showing the assembly of the guard plate of FIG. 2 installed on the car door shown in FIG. 1.

The complete assembly including guard plate 8 and installed handle mechanism 1 is described with reference to FIG. 5. The method of installation involves first unlocking the door 2 and opening it to expose a screw 17 that is accessible by an ordinary screwdriver. (Screw 17 extends into threaded hole 22 of rigid tongue member 21 of handle mechanism 1 when handle mechanism 1 is installed, rigidly attaching the rear portion of handle mechanism 1 tightly to the outer surface of door panel 2. A second screw 26, which is concealed by a piece of removable trim 24 that can be inserted in recess 23 in the outer surface of handle mechanism 1, extends through hole 25 in the front end of handle 1, through a bezel 27, and into a threaded hole 20 in the surface of door panel 2.)

After screws 17 and 26 have been removed, the handle mechanism 1 is removed. A bezel 19 having a rectangular opening therein through which the inner operative portion of handle mechanism 1 extends is provided on Volkswagen Rabbits and other similar vehicles to keep water out of door 2. This bezel or gasket may be reused or discarded, depending on the thickness of the stainless steel plate 9. The guard plate 10 then is inserted into opening 18 so that tab 14 and flanges 11 and 12 extend into the interior of door 2 through door panel opening 18. Alternately, the inner operative part of handle mechanism 1 can be inserted through opening 10 of guard plate 8 first, so that clearance hole 14 in tab 13 is aligned with threaded hole 22 in tongue member 1. Then both guard plate 8 and handle mechanism 1 are simultaneously inserted through opening 18 in door panel 2, aligning clearance hole 16 in the end plate of the door with both clearance hole 14 and threaded hole 22. If desired, bezel 19 can be used, or, a thinner bezel or no bezel at all may be used, since the combined thickness of the original bezel 19 and the thickness of guardplate 18 may be too great to allow proper alignment of holes 16 and 14, and threaded hole 22.

Installation is completed by rethreading screw 17 through clearance hole 16, clearance hole 14, and into threaded hole 22 of tongue member 21 and tightening it. Bezel 27 is positioned and screw 26 is tightened into threaded hole 20. The piece of trim 24 is reinserted into recess 23.

Figure 1:
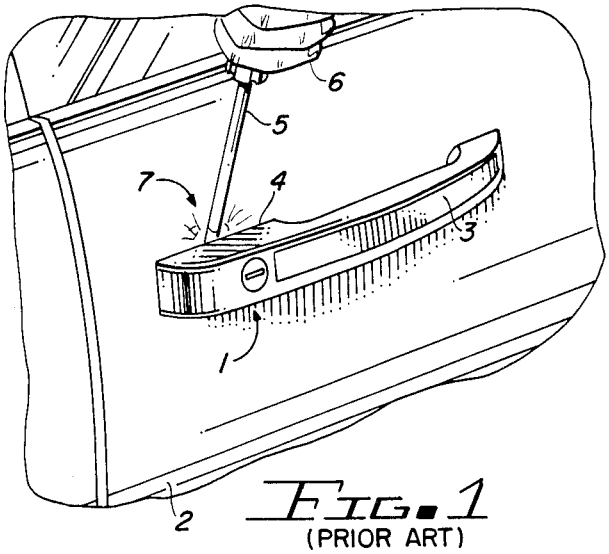
FIG. 1 (PRIOR ART)
FIG. 1 is a perspective view useful in describing the problem which the guard plate of the present invention solves.

Preferably, the outer peripheral portions of guard plate 8 extend above and below the horizontal edges of handle assembly 1 by approximately one-half inch. This distance is adequate to provide a very pleasing appearance, especially when the guard plate 8 is painted with "powder paint" material. This covers the damage 7 (FIG. 1) that has been done to the door panel if the lock previously has been forced, and more importantly, makes it very difficult for a would-be thief to open the door using the screwdriver forcing technique described above. The mere presence of the guard plate will have a deterrent effect on many would-be theives who wish to accomplish any burglary as quickly as possible. The cost of manufacturing the stainless steel guard plate 8 can be low, and it can be easily and securely installed properly in only a few minutes by anyone having a Phillips screwdriver of the proper size.

Figure 6:
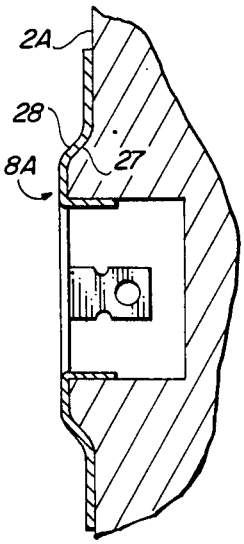
FIG. 6 is a partial section view of an alternate embodiment of the invention.
Figure 7:
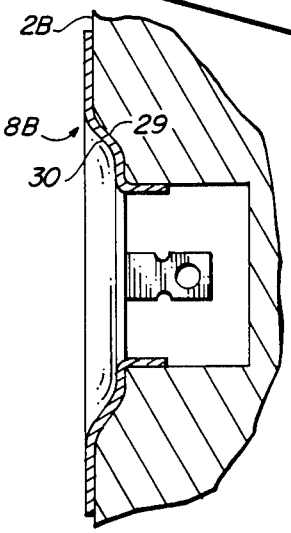
FIG. 7 is a section view of another alternate embodiment of the invention.

Certain vehicles that are easily broken into in the fashion described above have contours or recesses in their door panels around the region at which their handle mechanisms are installed. If this is the case, matching contours can be provided in the plate 9 of guard plate 8, as shown in FIGS. 6 and 7. In FIG. 6, the door panel 2A has an outward contour designated by reference numeral 27. Accordingly, modified guard plate A has a corresponding hump designated by reference numeral 28. In FIG. 7, the opposite configuration is shown, wherein reference numeral 29 designates a recess in the door panel around the door handle. Reference numeral 30 designates a matching recess in the guard plate 8B.

Although the invention has been described with reference to a particular embodiment thereof, those skilled in the art will be able to make various modifications to the described embodiment of the invention without departing from the true spirit and scope thereof. For example, the tab 13 could be omitted in some instances, if the forces drawing the handle mechanism against the guard plate and hence pressing the guard plate tightly against the door panel, are adequate.

I claim:

1. A mechanism for preventing unauthorized forcing of the lock of an automobile door by means of a screwdriver or the like, the mechanism comprising:

(a) a rigid guard plate having an aperture therein and having integral first and second flanges extending inwardly from opposed upper and lower edges of the aperture into an opening in an outer surface of the automobile door;

(b) a handle mechanism having a handle portion and also having an operative portion extending through the aperture in the guard plate and through the opening for actuating a latching mechanism; and (c) means for anchoring the operative portion of the handle mechanism to an interior portion of the door and simultaneously anchoring the guard plate to the interior of the door.

2. The mechanism of claim 1 wherein the guard plate includes a rigid tab extending inwardly from an edge of the aperture between the first and second flanges, the rigid tab having a clearance hole therein which is aligned with a threaded hole of the operative portion of when the handle mechanism is properly inserted through the aperture of the rigid plate.

3. The apparatus of claim 2 wherein the first and second flanges and the rigid tab are integral with the guard plate, and wherein the guard plate is of stainless steel.

4. The apparatus of claim 3 wherein the guard plate is generally oblong, and wherein the guard plate extends beyond an edge of the handle mechanism when the handle mechanism in inserted in the aperture by a distance which is sufficiently small that the periphery of the guard plate cannot be easily pried outward from the outer surface of the automobile door.

5. The apparatus of claim 4 including a bezel to be positioned between the handle mechanism and an outer surface of the guard plate when the handle mechanism is inserted through the aperture of the guard plate.

6. A method of preventing forced entry of an elongated object, such as a screwdriver or the like, between a handle mechanism of an automobile door and an outer surface of a panel of the door and into an interior door locking mechanism of the door, the door having an end panel that is exposed only when the door is opened, the method comprising the steps of:

(a) opening the door to expose a first screw extending through a first clearance hole in the end panel of the door and into a threaded hole in a rigid tongue member of the handle mechanism, removing the first screw and also removing a second screw extending through a second clearance hole in a forward portion of the handle mechanism and into a threaded hole in the outer surface of the door panel;

(b) pulling the handle mechanism out of an opening in the outer surface of the door panel;

(c) inserting a guard plate having an aperture therein for receiving an operative portion of the handle mechanism and having upper and lower integral flanges extending inwardly from upper and lower edges of the aperture, into the opening in the door panel;

(d) inserting the operative portion of the handle mechanism through the aperture in the guard plate between the upper and lower flanges, aligning the threaded hole of the rigid tongue member with the first clearance hole; and (e) rethreading the first screw through the first clearance hole and into the threaded hole of the tongue member, and tightening the first screw to thereby press the operative portion of the handle mechanism against the outer surface of the guard plate and thereby force the guard plate against the outer surface of the door panel, and installing the second screw through the second clearance hole and into the threaded hole in the outer surface of the door panel.

7. The method of claim 6 wherein the operative portion of the handle mechanism is inserted through the aperture in the guard plate and then both the operative portion of the handle mechanism and the upper and lower flanges of the guard plate are inserted through the opening in the door panel.

8. The method of claim 7 including aligning a rigid tab extending inwardly from a rear edge portion of the aperture in the guard plate with the first clearance hole, and inserting the first screw through a first clearance hole in the tab and then threading the first screw into the threaded hole of the tongue member.

9. A method of preventing forced entry of an elongated object, such as a screwdriver or the like, between a handle mechanism of an automobile door and an outer surface of a panel of the door and into an interior door locking mechanism of the door, the door having an end panel that is exposed only when the door is opened, the method comprising the steps of:

(a) opening the door to expose a screw extending through a clearance hole in the end panel of the door and into a threaded hole in a rigid tongue member of the handle mechanism and removing the screw;

(b) pulling the handle mechanism out of an opening in the outer surface of the door panel;

(c) inserting a guard plate having an aperture therein for receiving an operative portion of the handle mechanism and having upper and lower integral flanges extending inwardly from upper and lower edges of the aperture, into the opening in the door panel;

(d) inserting the operative portion of the handle mechanism through the aperture in the guard plate between the upper and lower flanges, aligning the threaded hole of the rigid tongue member with the first clearance hole; and (e) rethreading the screw through the clearance hole and into the threaded hole of the tongue member, and tightening the screw to thereby press the operative portion of the handle mechanism against the outer surface of the guard plate and thereby force the guard plate against the outer surface of the door panel.

* * * * *